US007884781B2

(12) United States Patent
Whight

(10) Patent No.: US 7,884,781 B2
(45) Date of Patent: Feb. 8, 2011

(54) VIDEO DATA SIGNAL CORRECTION

(75) Inventor: Kenneth R. Whight, Partridge Green (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 1080 days.

(21) Appl. No.: 10/596,217

(22) PCT Filed: Dec. 8, 2004

(86) PCT No.: PCT/IB2004/052704

§ 371 (c)(1),
(2), (4) Date: Jun. 5, 2006

(87) PCT Pub. No.: WO2005/057544

PCT Pub. Date: Jun. 23, 2005

(65) Prior Publication Data

US 2007/0159416 A1 Jul. 12, 2007

(30) Foreign Application Priority Data

Dec. 10, 2003 (GB) ..... 0328584.8

(51) Int. Cl.
*G09G 3/30* (2006.01)

(52) U.S. Cl. ..... 345/76

(58) Field of Classification Search ..... 345/76–87
See application file for complete search history.

(56) References Cited

U.S. PATENT DOCUMENTS

| | | | | |
|---|---|---|---|---|
| 6,359,605 | B1 | 3/2002 | Knapp et al. | |
| 2004/0150590 | A1 * | 8/2004 | Cok et al. | 345/76 |
| 2006/0077135 | A1 * | 4/2006 | Cok et al. | 345/76 |
| 2006/0087588 | A1 * | 4/2006 | Cok | 348/556 |

FOREIGN PATENT DOCUMENTS

| | | | |
|---|---|---|---|
| EP | 1003150 | A1 | 5/2000 |
| EP | 1221686 | A2 | 7/2002 |
| WO | 0195301 | A1 | 12/2001 |

* cited by examiner

*Primary Examiner*—Amare Mengistu
*Assistant Examiner*—Jennifer Zubajlo

(57) ABSTRACT

A method and apparatus for correcting video data signals for addressing an active matrix electroluminescent display device wherein input video signals are modified in accordance with stored electrical characteristic parameter values for each drive transistor (20) employed to control the current through a respective display element (11). The stored values are continually updated to ensure accurate data signal correction which counteracts variations in the electrical characteristics of each drive transistor such as threshold voltage drift, for example. A power line (10) supplies current to n display elements (11). Thus, n sets of data relating to the current through the power line are collected during normal operation of the display, for example. The data is used to calculate updated characteristic parameter values for each drive transistor (20).

11 Claims, 4 Drawing Sheets

VIDEO DATA SIGNAL CORRECTION

This invention relates to a method and apparatus for correcting video data signals for addressing active matrix electroluminescent display devices, particularly those having transistors for controlling the current through individual display elements.

Matrix display devices employing electroluminescent, light-emitting, display elements are well known. The display elements may comprise organic thin film electroluminescent elements, for example using polymer materials, or else light emitting diodes (LEDs) using traditional III-V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer.

The polymer material can be fabricated using a CVD process, or simply by a spin coating technique using a solution of a soluble conjugated polymer. Ink-jet printing may also be used. Organic electroluminescent materials exhibit diode-like I-V properties, so that they are capable of providing both a display function and a switching function, and can therefore be used in passive type displays. Alternatively, these materials may be used for active matrix display devices, with each pixel comprising a display element and a switching device for controlling the current through the display element.

Display devices of this type have current-driven display elements, so that a conventional, analogue drive scheme involves supplying a controllable current to the display element. It is known to provide a current source transistor as part of the pixel configuration, with the gate voltage supplied to the current source transistor determining the current through the display element. A storage capacitor holds the gate voltage after the addressing phase.

FIG. 1 shows a part of a known arrangement of an active matrix electroluminescent display device. The display device comprises a panel having a row and column matrix array of regularly-spaced pixels, denoted by the blocks 1 located at the intersections between crossing sets of row (selection) and column (data) address conductors 2 and 4. Only a few pixels are shown in the Figure for simplicity. In practice, there may be several hundred rows and columns of pixels. The pixels 1 are addressed via the sets of row and column address conductors by a peripheral drive circuit comprising a row, scanning, driver circuit 6 and a column, data, driver circuit 7 connected to the ends of the respective sets of conductors. Power lines 10 are arranged to supply current to respective groups of pixels. In this example, each power line 10 supplies current to pixels in an associated row.

FIG. 2 shows in simplified schematic form a known pixel and drive circuitry arrangement for providing voltage-programmed operation. Each pixel 1 comprises an EL display element 11 and associated driver circuitry. The electroluminescent display element 11 comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 11 closest to the substrate may consist of a transparent conductive material such as ITO so that light generated by the electroluminescent layer is transmitted through these electrodes and the support so as to be visible to a viewer at the other side of the support.

The driver circuitry has an address transistor 16 which is turned on by a row address pulse on the row conductor 2. When the address transistor 16 is turned on, a video data voltage on the column conductor 4 can pass to the remainder of the pixel. In particular, the address transistor 16 supplies the data voltage to the gate of a drive transistor 20. The gate is held at this voltage by a storage capacitor 22 even after the row address pulse has ended. The drive transistor 20 draws a current from the power line 10.

The above basic pixel circuit is a voltage-programmed pixel, and there are also current—programmed pixels which sample a drive current. However, all pixel configurations require current to be supplied to each pixel.

The address circuitry commonly employs thin film transistors (TFTs) which are well known for addressing active matrix display devices. It is known that variations in the electrical characteristics of the TFTs in an array can lead to non-uniformities in the display output. For example, drive transistors in two adjacent pixels having different threshold voltages, and addressed with equal data voltages are likely to produce different output intensities. Other variable characteristics include the mobility of the TFT and other current-voltage relationships. There are several possible causes of these variations.

Fabrication of these devices is often by photolithography wherein various conductive, insulating and semiconducting materials are deposited and patterned on a substrate. Small variations in the dimensions of the TFTs can lead to differences in their electrical characteristics.

Aging effects can also change the characteristics of TFTs over their operational lifetime. This is particularly apparent with amorphous silicon TFTs which are known to suffer from threshold voltage drift when employed to control continuous currents. However, TFTs made from polysilicon technology are more likely to suffer from electrical characteristic variations caused by structural differences stemming from the manufacturing stages.

There is a desire to adopt the more established amorphous silicon technology in the manufacture of active matrix electroluminescent displays so that existing fabricating plants, previously used for making AMLCD arrays, can be used. However, the problems associated with amorphous silicon TFT stability inhibit their use as drive transistors.

In an attempt to overcome these problems, modifications to the individual pixel circuits have been proposed in which the electrical characteristics of each drive transistor are measured at the pixel level. Subsequent data signals are then corrected accordingly. This usually requires the addition of several components, including more TFTs, to the basic pixel circuit resulting in a more expensive and complex manufacturing process and an array of pixels having a reduced aperture.

WO01/95301 discloses a display having a uniformity correction circuit which measures the current through individual pixels during a calibration mode wherein each pixel is addressed one at a time with known data signals. The information for each pixel is stored and used to determine data signals to be applied to the pixels during normal operation.

According to one aspect of the present invention there is provided a method of correcting video data signals for addressing an active matrix display device, the device comprising a power line arranged to supply current to n electroluminescent display elements, the current supplied to each element being controllable by a respective drive transistor, each drive transistor being addressable by video data signals and having an electrical characteristic parameter X, the method comprising the steps of:

(i)—storing an X value for each drive transistor;

(ii)—receiving a set of video data signals, each having a value $v_d$;

(iii)—determining from the stored X values and the received $v_d$ values an expected current through the power line $I_p$ using a model which relates the power line current to the $v_d$ and X values of the drive transistors;

(iv)—measuring the current $I_m$ through the power line when the drive transistors are each addressed with the received set of video data signals;

(v)—calculating the difference g between the expected current $I_p$ and the measured current $I_m$;

(vi)—repeating steps (ii) to (v) for at least n−1 further sets of video data signals;

(vii)—calculating an X value for each transistor using the calculated g values;

(viii)—replacing the stored X values with the calculated X values; and (ix)—correcting subsequent video data signals in accordance with the stored X values. For the purposes of this specification, the term "electrical characteristic parameter" will mean a value for an electrical property of the associated transistor. Such property will include those which affect the voltage-current characteristics of the transistor such as threshold voltage and mobility.

Advantageously, the method according to the invention allows the determination of electrical characteristic parameters for each transistor without the need for making individual measurements on each transistor. Therefore, the method can be carried out during normal operation of the display device.

For a power line supplying current to n display elements, the total supplied current on the power line is a function of the electrical properties of the n associated drive transistors and the data signals thereon. The data signal values applied to the drive transistors are known. A model relating the data signal values to a given electrical characteristic is used to predict the power line current. Therefore, by collecting n sets of linearly independent data related to the power line current and the data signal values, the unknown values of the given electrical characteristic can be calculated using various calculating processes. These calculated values are then used to correct video data signals accordingly. Any shift in these values is therefore taken account of by the subsequently addressed data signals.

This method can be applied periodically throughout the operation of the device to provide regular updates of the stored electrical characteristics of the drive transistors in order to allow accurate addressing of the display. In addition to, or instead, the method can be carried out in response to the switching on of the display device. Alternatively, a bright bar could sweep the display screen each time the channel is changed. Advantageously, this changing image would provide n sets of linearly independent data relating the power line current to the applied data voltages and the unknown electrical characteristic parameters.

According to a second aspect of the present invention there is provided apparatus for correcting video data signals for addressing an active matrix display device, the device comprising a power line arranged to supply current to n electroluminescent display elements, the current supplied to each element being controllable by a respective drive transistor, each drive transistor being addressable by video data signals each having a value $v_d$ and having an electrical characteristic parameter X, the apparatus comprising means for storing an X value for each drive transistor, means for applying a model to determine an expected current through the power line using the stored X values and video data signal values $v_d$, means for measuring the current through the power line, means for applying an algorithm to said expected current and said measured current for a plurality of sets of video data signals to determine X values for each drive transistor, and correction circuitry for modifying received video data signals in accordance with the stored X values.

Advantageously, no additional addressing components are required for the individual display elements. Instead the apparatus provides a non-intrusive way of establishing up-to-date values for given electrical characteristics of the associated drive transistors to enable accurate correction of video data signals. With suitable connections to an array of pixels, the apparatus can be integrated into a single chip. This allows simple integration of the correction scheme into an active matrix display device having conventional addressing circuitry. In such a case, the chip can be arranged to correct input video display signals before supplying them to the row and column drivers.

Preferably, each power line in an active matrix display device has apparatus according to the invention associated therewith. Advantageously, variations in the electrical characteristics of all drive transistors in the active matrix display can therefore be counteracted by correction of the data signals.

In a preferred embodiment, the calculation of the X value for each drive transistor employs an iterative Newton Linearisation process on a matrix of collected data. In this, the data representing the difference values $g_i$, for the $i^{th}$ data set, are stored in a column vector, say G, for values of i between 1 and n. An iterative Newton Linearisation process is then carried out using the vector G to obtain a discrepancy value δX for the X value of each drive transistor. This process may include the steps of:

differentiating vector G to obtain an n×n matrix G'; and solving the equation:

$$G'(X).\delta X=-G(X)$$

for δX. The X value for each transistor is then updated using this calculated discrepancy value and the difference values g are recalculated using the updated X values and the original video data signal values $v_d$. This process can be carried out iteratively by repeating the updating of the X values until the g values are sufficiently close to zero, i.e. when the current predicted from theory (using the new X values) substantially matches the measured current.

The process allows n unknown values to be determined using n sets of linearly independent data which relate the unknown and known values. In this way, the n electrical characteristic parameter values X can simply be calculated when n sets of linearly independent data, relating the X values to known linearly independent $V_d$ vectors, have been collected. This allows the process to be carried out during normal operation of the display device without the need for any calibration which, advantageously, does not disturb the user's viewing. By addressing the drive transistors with n sets of linearly independent video data signals in turn, and measuring the power line current for each $V_d$ vector, the calculated data can be stored in respective rows of a vector having n rows. When this is full, a Newton Linearisation process can be carried out to determine electrical characteristic parameter values for each drive transistor.

Solving the above equation may require inverting the n×n matrix G' or performing an LU decomposition thereon. Successful solution of a given matrix requires that the matrix is non-singular. In order to ensure that G' is non-singular, the drive transistors are preferably driven with sets of video data signals which have predetermined $v_d$ values. This may be done by displaying a predetermined image. A detection process may also be carried out in which the input video data signals are analysed in order to determine when linearly independent $v_d$ values are being input to enable successful calculation of the electrical characteristic parameters.

The threshold voltage $v_t$ of each drive transistor has a significant effect on the voltage-current characteristics and therefore any threshold voltage drift can have a detrimental effect on the uniformity of any output image from the display. The electrical characteristic parameter X can be the threshold voltage $v_t$. In this case, values of $v_t$ for each drive transistor are stored and replaced with calculated values of $v_t$ in accordance with the invention. The stored $v_t$ values are then used to correct input video data signals to compensate for any variation in the $v_t$ values from one transistor to another.

A model relating the power line current to the video data signal value $v_d$ and the unknown electrical characteristic parameter X for each drive transistor is employed to determine an expected current through the power line using values of $v_d$ and X. The model is preferably established by using known voltage-current characteristics of drive transistors and their interaction with electroluminescent display elements.

In the case of the electrical characteristic parameter X being the threshold voltage $v_t$, the model may be based upon the relationship given by the equation:

$$i_{LED}=K(V_d-v_t)^2$$

in which $i_{LED}$ is the current controlled by one drive transistor and K is a constant.

Examples of the invention will now be described in detail with reference to the accompanying drawings, in which.

Figure 1:
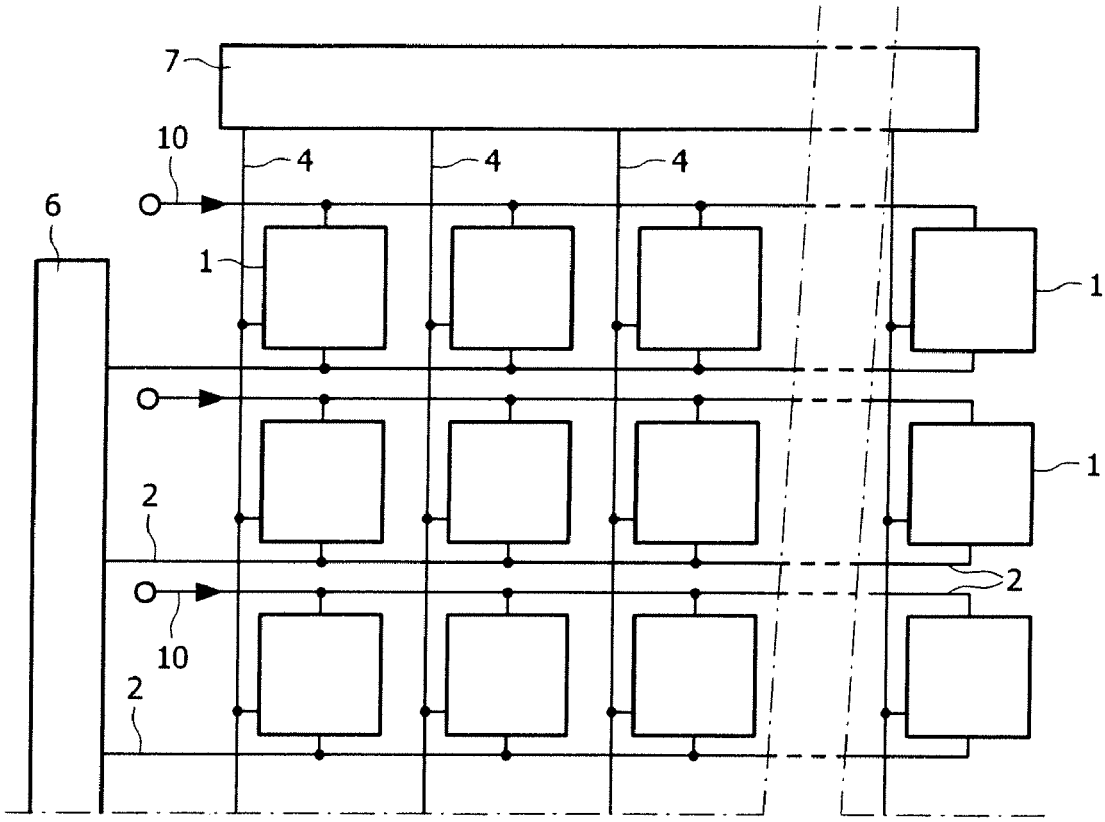
FIG. 1 PRIOR ART
FIG. 1 shows a conventional active matrix LED display.

It should be noted that the figures are diagrammatic and not drawn to scale. Relative dimensions and proportions of parts of these figures have been shown exaggerated or reduced in size, for the sake of clarity and convenience in the drawings. The same reference numbers are used throughout the Figures to denote the same or similar parts.

Figure 2:
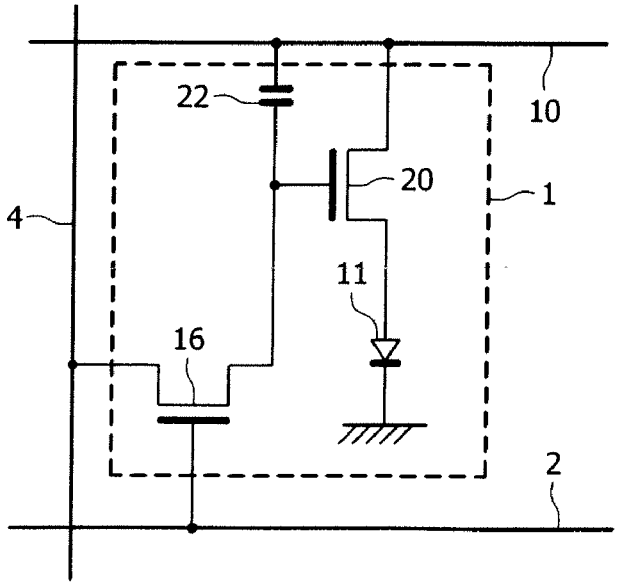
FIG. 2 PRIOR ART
FIG. 2 shows a conventional pixel circuit for the display of FIG. 1.

The method of the invention can be implemented in an active matrix electroluminescent display device having a typical arrangement of pixels and address circuitry as shown by FIGS. 1 and 2 and described above in relation to known devices. In brief, a power line 10 is arranged to supply current to n electroluminescent display elements 11. In the example shown, each row of pixels 1 shares a common power line 10. Each pixel 1 comprises an electroluminescent display element 11 and a drive transistor 20. The current supplied to each display element 11 is controllable by the drive transistor 20. FIG. 2 shows the current-carrying terminals of the drive transistor being connected between the associated power line 10 and the anode of the LED display element 11. However, other arrangements are possible which allow the drive transistor to perform substantially the same function.

Each drive transistor is addressable by video data signals. These signals are in the form of voltages having a value $v_d$ and are supplied to the column address lines 4 by the column driver 7. An address transistor 16 is switched on by a row select pulse which allows the data voltage to address the drive transistor 20. The magnitude of $v_d$ applied to the gate of the drive transistor 20 determines the current allowed to pass through the transistor and therefore the amount to be supplied to the display element 11. The gate is held at this voltage by a storage capacitor 22 even after the row address pulse has ended.

Thin film transistors (TFTs) are employed for the drive transistors 20. These are formed on an substrate together with the other address circuitry using well known techniques such as photolithography. The electrical characteristics of TFTs in an array tend to differ from one TFT to another. These differences are caused by structural and aging effects leading to changes in threshold voltage and mobility, for example, throughout the lifetime of the display device leading to non-uniformities in the displayed image. The magnitude of a given electrical characteristic can be represented by a parameter X.

The invention can be applied to counteract the effects of these voltage-current characteristic changes. The following described embodiment provides a method of correcting video data signals by taking account of threshold voltage drift. That is to say, $X \equiv v_t$. TFTs having an amorphous silicon channel are known to suffer significantly from threshold voltage drift.

Figure 3:
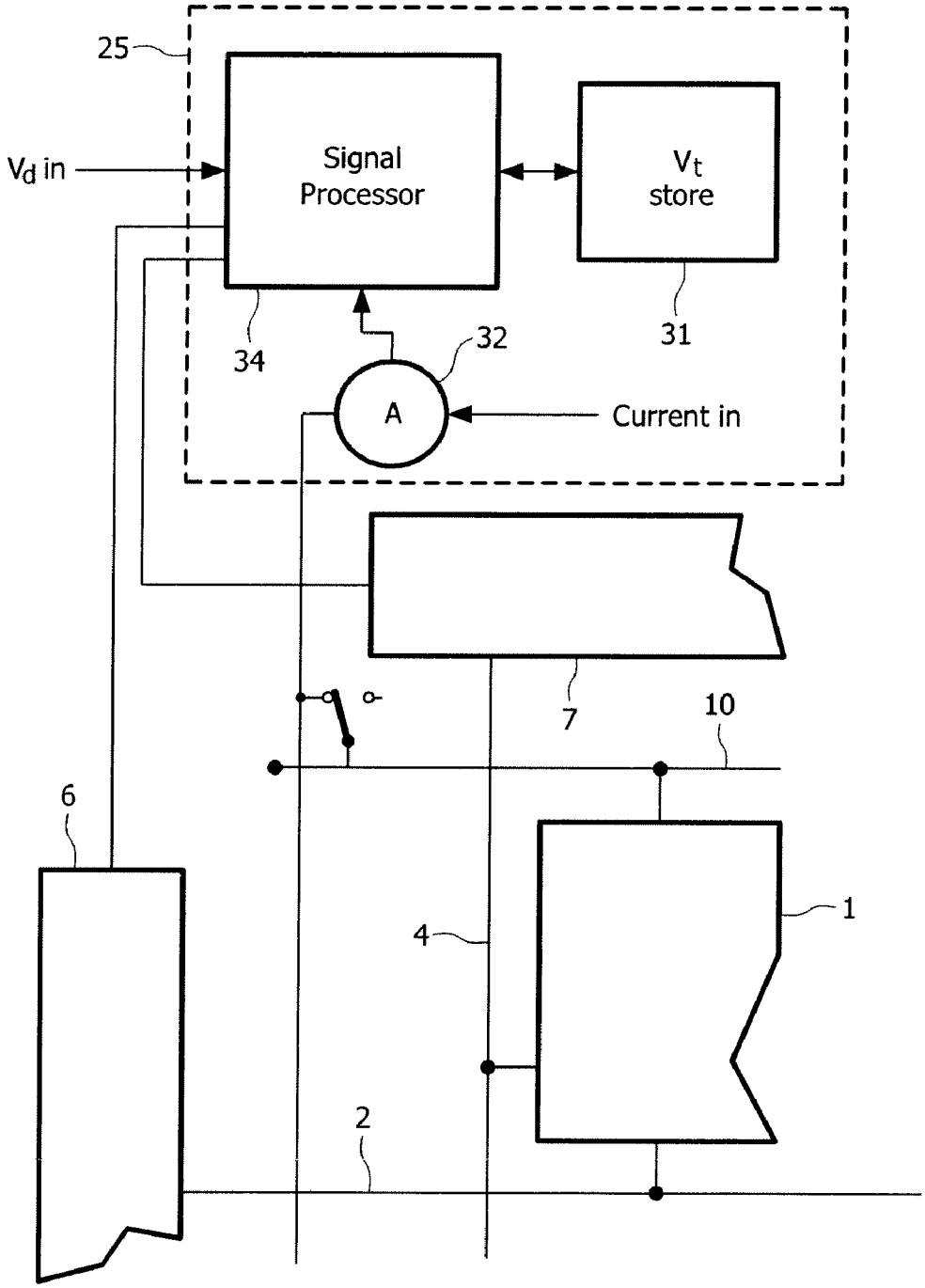
FIG. 3 shows part of an active matrix display device having apparatus for correcting video data signals.

FIG. 3 shows part of an active matrix electroluminescent display device having all of the components of the known arrangement shown in FIG. 1. The apparatus required for implementing the invention can be contained in an IC chip represented by block 25. The IC chip 25 is switchably connected to a group of power lines 10 and serves to correct video data signals for addressing the pixels connected to one power line at a time. Only one power line 10 is shown in FIG. 3 for simplicity.

The apparatus comprises a $V_t$ store 31 which serves to store a threshold voltage value $v_t$ for each drive transistor associated with the power line 10. An ammeter 32 is connected between the power line 10 and the current supply to the display device. This serves to measure the total current through the power line 10 during operation.

Video data voltages having values $v_d$ are input to a signal processor 34. The signal processor comprises correction circuitry for modifying received video data voltages in accordance with the stored $v_t$ values. The corrected data voltages are then supplied to the column driver 7 for addressing the pixels 1. In this way, the data voltages used to address the pixels are corrected to counteract any variation in the threshold voltages of the associated drive transistors 20. Corresponding timing signals are supplied by the signal processor 34 to the row driver 6 to control the application of the row select pulses to the row address conductors 2 of the display.

The signal processor 34 further comprises means for applying a model to determine an expected current through the power line 10 using the stored $v_t$ values and input video data voltages $v_d$. The processor 34 also includes means for applying an algorithm to the expected current (calculated using the model) and the measured current (measured by the ammeter 32) for a number of sets of video data voltages to determine threshold voltage values $v_t$ for each drive transistor 20.

As mentioned above, the IC chip 25 is switchably connected to other power lines 10 in the array. Therefore, by switching to other power lines, video data voltages supplied to the drive transistors 20 associated with the connected power line can be corrected in a similar manner to that described. It is envisaged that several IC chips 25 can each be associated with a group of power lines 10. In this way, several chips can operate in parallel thereby correcting data signals for several rows simultaneously. However, for simplicity, the operation of the apparatus will be described in relation to one power line, and therefore one row of pixels, only.

An example method of implementing the invention on the apparatus of FIG. 3 will now be described with reference to the flow diagram shown in FIG. 4. For each drive transistor 20 associated with the pixels 1, supplied with current from the power line 10, a threshold voltage value $v_t$ is stored by the $V_t$ store 31. These values are taken from the stored values from the previous operation of the display. However, all may initially be set at an estimated, or modelled value. This may be 2 volts for example. This step is referenced at 410 in FIG. 4.

The signal processor 34 receives a set of video data voltages having values $v_d$, referenced at 412. These are input to the display device and each correspond to an intensity level to be output by a given pixel so as to provide an output image. Each $v_d$ value is corrected by the data processor 34 to take account of the threshold voltage value $v_t$ of the drive transistor 20 of the pixel to which the data voltage corresponds.

A model is used to determine the current expected to flow through the power line 10 when the associated drive transistors are addressed with the received set of video data signals. This process, referenced at 420, is carried out by the signal processor 34. The model is based on the relationship between the current which flows through one display element 11, the video data voltage $v_d$ applied to the gate of the drive transistor 20, and the threshold voltage $v_t$ of the drive transistor. This model can be established as follows:

For a TFT in saturation the drain current $i_d$ can be expressed as:

$$i_d = \frac{k}{2}(v_{gs} - v_t)^2 \tag{1}$$

where k is the device transconductance parameter and $v_{gs}$ is the gate-source voltage of the TFT. For the LED display element 11, the forward current through the LED $i_{LED}$ can be expressed as:

$$i_{LED}=Av_D^m \tag{2}$$

where A and m are constants and $v_D$ is the voltage across the LED display element 11. It is a good approximation for m=2. Therefore, $$i_{LED}=Av_D^2 \tag{3}$$

It is known that the video data voltage $v_d$ which is applied to the gate of the drive transistor 20 can be divided into two parts such that, $$v_d=v_{gs}+v_D \tag{4}$$

Rearranging and substituting using equations (1), (3) and (4) gives $$i_{LED}=K(v_d-v_t)^2 \tag{5}$$

wherein K is a constant. For a power line supplying power to n pixels, the expected current $i_p$ through the power line 10 is the sum of all of the individual pixel currents through each LED and can be expressed as a function of the threshold voltages:

$$i_p = \sum_{i=1}^{n} i_{LED} = f(V_t) \tag{6}$$

where $V_t$ is a stored vector (length n) of threshold voltages and $i_p$ is the total current through the power line 10 when the associated drive transistors 20 are addressed with a particular set of video data voltages $V_d$.

The drive transistors 20 associated with the power line 10 are then addressed with the first set of received video data voltages $V_{d1}$. These data voltages may be stored in a separate $v_d$ store (not shown). The ammeter 32 is then used to measure the current $I_m$ through the power line 10, this step being referenced at 430. The measurement preferably occurs for a predetermined duration once the video data voltages have been applied to the gates of the drive transistors 20.

Referenced at 440, the discrepancy between the expected current $i_p$ and the measured current $i_m$ is then calculated for the first data set:

$$g_1(V_t)=f_1(V_t)-i_{m1} \tag{7}$$

wherein $g_1(V_t)$ represents the discrepancy for the first set of data voltages. This gives an indication of the accuracy of the stored $v_t$ values. For example, if the stored $v_t$ values are substantially accurate, then the resulting discrepancy value $g_1(V_t)$ will be minimal, perhaps zero. In this case, the apparatus may cease the correction process at this point because the stored $v_t$ values are accurate to, at least, a predetermined threshold. The correction process would then restart after a predetermined period, for example, when the display device is next switched on.

If however, there is a non-zero discrepancy between the expected current $i_p$ and the measured current $i_m$ then $g_1(V_t)$ is stored in the first row, i=1, of a vector $G(V_t)$, wherein:

$$G(V_t)=F(V_t)-i_m \tag{8}$$

wherein $G(V_t)$ and $F(V_t)$ have n rows.

There are n unknown values of $v_t$ corresponding to the n pixels associated with the power line 10. Therefore, n sets of linearly independent data are required in order to determine the n threshold voltage values. To provide these sets of data, the above-described process is repeated with at least a further n−1 sets of video data voltages having values $v_d$. For the $i^{th}$ set of video data voltages, the calculated discrepancy using equation (7), is entered into row i of vector $G(V_t)$. The process is repeated, referenced at 450, until the vector is full. This can be carried out during normal operation of the display device when the pixels of the array are being addressed with sets of video data voltages corresponding to an image to be displayed. Linearly dependent video data voltage sets $V_d$ may be discarded so that the matrix G achieved is non-singular. However, it should be noted that the video data voltage sets associated with the collected data are stored so that they can be used for iterative calculations.

Figure 4:
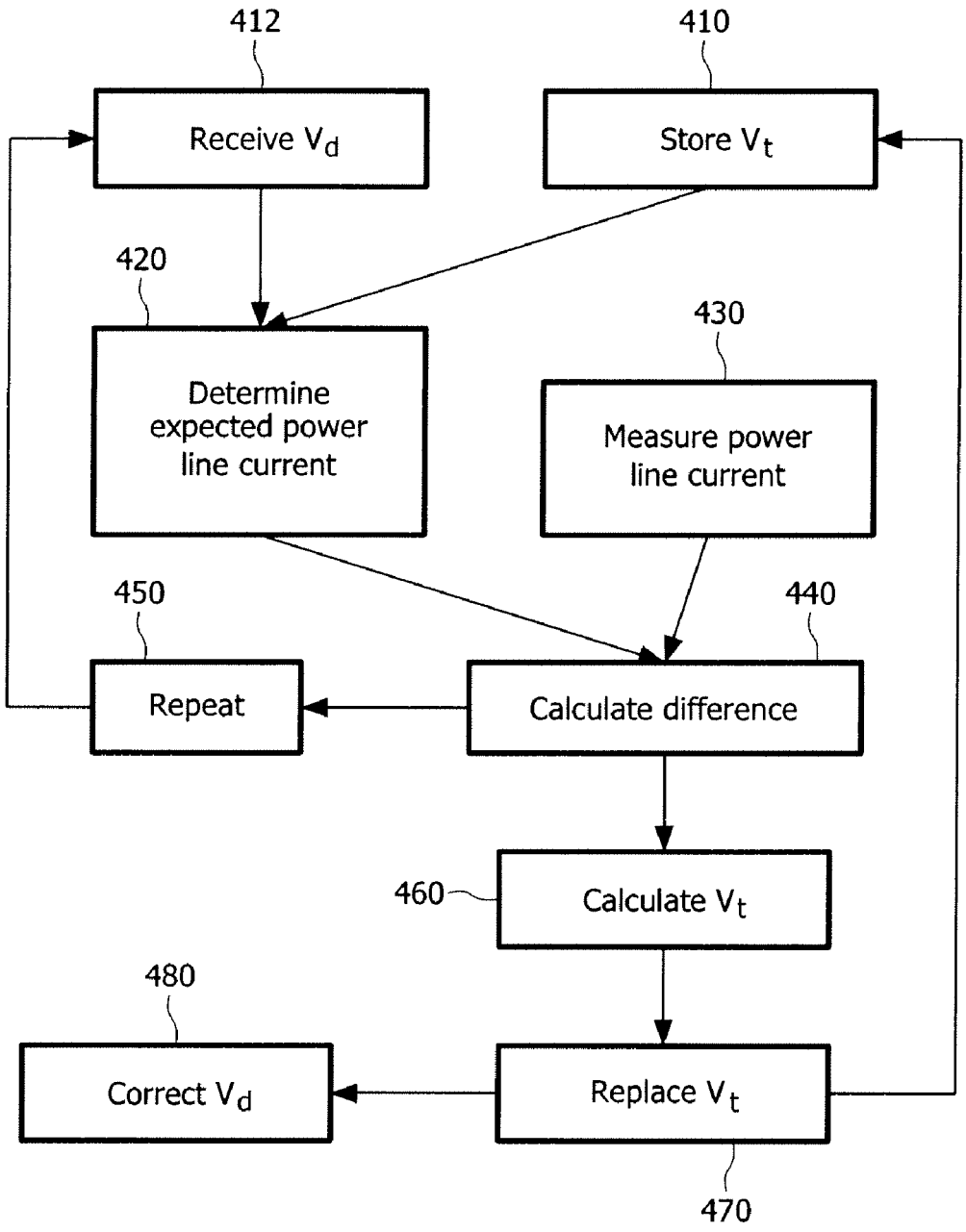
FIG. 4 is a flow diagram showing an example method of correcting video data signals according to the invention.
Figure 5:
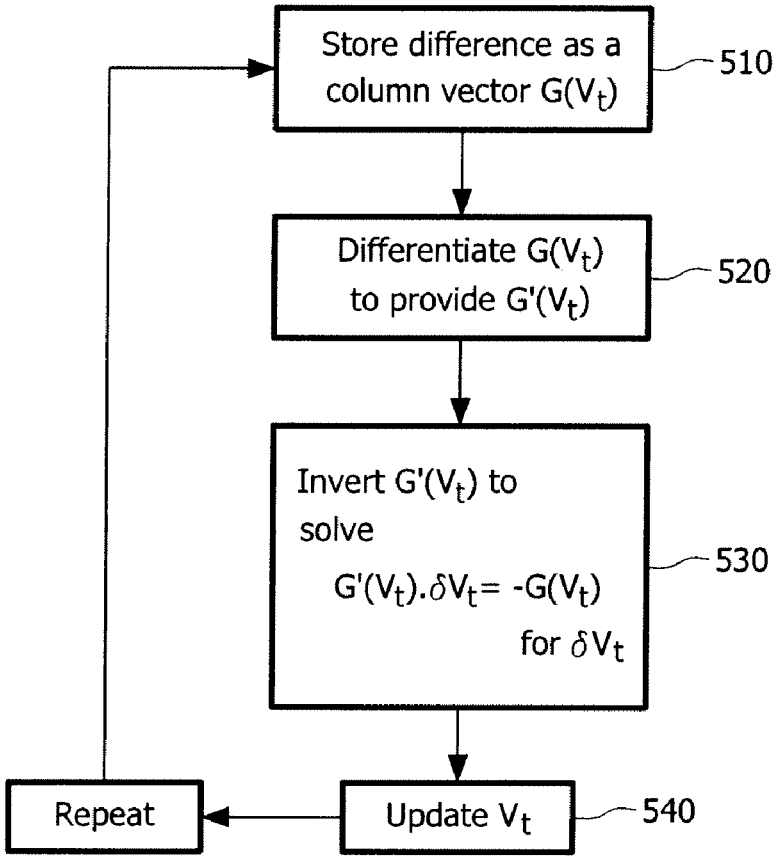
FIG. 5 is a flow diagram showing an example method of calculating threshold voltage values for each transistor in accordance with the invention.

The calculated discrepancy values $g(V_t)$ are then used to calculate a threshold voltage $v_t$ for each drive transistor 20, referenced at 460 in the flow diagram of FIG. 4. An example method of this step is shown in detail in FIG. 5, in which an iterative Newton Linearisation process is performed on G to obtain a discrepancy value $\delta v_t$ for the threshold voltage value $v_t$ of each transistor.

The vector $G(V_t)$ is stored 510 by the signal processor 34. To carry out the Newton Linearisation on vector $G(V_t)$, the following equation must be solved for $\delta V_t$ (a vector of length n):

$$G'(V_t).\delta V_t = -G(V_t) \quad -(9)$$

Firstly, this requires $G(V_t)$ to be differentiated with respect to $V_t$ using the stored video data voltage set $V_d$ to obtain an n×n matrix $G'(V_t)$ such that:

$$G'(V_t) = \begin{pmatrix} \frac{\partial f_1}{\partial v_{t1}} & \frac{\partial f_1}{\partial v_{t2}} & \cdots & \cdots \\ \frac{\partial f_2}{\partial v_{t1}} & \cdots & \cdots & \cdots \\ \cdots & \cdots & \cdots & \frac{\partial f_{n-1}}{\partial v_{tn}} \\ \cdots & \cdots & \frac{\partial f_n}{\partial v_{t(n-1)}} & \frac{\partial f_n}{\partial v_{tn}} \end{pmatrix} \quad (10)$$

Secondly, this n×n matrix is inverted to solve equation (9) for $\delta V_t$ such that:

$$G'(V_t)^{-1}.G(V_t) = \delta_t \quad -(11)$$

The matrix $G'(V_t)$ must be non-singular to allow successful inversion. If $G'(V_t)$ is singular then it may be necessary to repeat at least part of the data collecting process for further sets of video data voltages. This may be indicated by a failure of the iterative Newton Linearisation process to converge to a solution.

The resulting vector $\delta V_t$ contains the discrepancies between the stored threshold voltage values and the calculated threshold voltage values.

Therefore, updated threshold voltage values for each drive transistor can be calculated 540 by modifying the stored $v_t$ values using the calculated discrepancy values contained in vector $\delta V_t$.

Vector G is then updated by recalculating g values using the new $v_t$ values and the stored $v_d$ values. This process is then repeated until the g values are within a predetermined range around zero, i.e. when the currents predicted from theory (using the new $v_t$ values) substantially matches the measured currents.

The stored threshold voltage values are then replaced, 470, with the newly calculated threshold voltage values. Subsequent video data signals are then corrected, 480, by the signal processor 34 in accordance with the stored $v_t$ values before they address the associated drive transistors 20.

The above-described embodiment involves the correction of video data voltages for n electroluminescent display elements 11. For higher values of n, the data processing will involve more current measurements and more complex calculations. It should be appreciated that the n display elements can be located in more than one row. For example, the total current supplied to the display elements of two adjacent rows in the array could be measured by regarding their associated power lines as a single power line. In this case, each of the respective current measurements can be combined to give the total current supplied to the n display elements which is required for the calculations in accordance with the invention.

It will also be appreciated that the above-described method can be applied to the correction of data signals to overcome variations in other electrical characteristics of the drive transistors or the LEDs such as TFT mobility and LED efficiency. Of course, this may require a different model in which such parameters appear explicitly in order to predict the power line current $i_p$.

It is envisaged that other numerical methods may be adopted to calculate the electrical characteristic parameter X, instead of the iterative Newton Linearisation employed in the above-described embodiment. For example, equation (9) could be solved by using a L.U. Decomposition or Gaussian elimination.

In summary, there is provided a method and apparatus for correcting video data signals for addressing an active matrix electroluminescent display device in which input data signals are modified in accordance with stored electrical characteristic parameter values for each drive transistor 20 employed to control the current through a respective display element 11. The stored values are continually updated to ensure accurate data signal correction which counteracts variations in the electrical characteristics of each drive transistor such as threshold voltage drift for example. A power line 10 supplies current to n display elements. n sets of data relating to the current through the power line are collected during normal operation of the display for example. The data is used to calculate updated characteristic parameter values for each drive transistor 20.

From reading the present disclosure, other variations and modifications will be apparent to persons skilled in the art. Such variations and modifications may involve equivalent and other features which are already known in the art and which may be used instead of or in addition to features already described herein.

The invention claimed is:

1. A method of correcting video data signals for addressing an active matrix display device, the device comprising a power line (10) arranged to supply current to n electroluminescent display elements (11), the current supplied to each element being controllable by a respective drive transistor (20), each drive transistor being addressable by video data signals and having an electrical characteristic parameter X, the method comprising the steps of:

(i)—storing an X value for each drive transistor;

(ii)—receiving a set of video data signals, each having a value $v_d$, said video data signals corresponding to an image to be displayed;

(iii)—determining from the stored X values and the received $v_d$ values an expected current through the power line $i_p$ using a model which relates the power line current to the $v_d$ and X values of the drive transistors;

(iv)—measuring the current $i_m$ through the power line when the drive transistors are each addressed with the received set of video data signals;

(v)—calculating the difference, g, between the expected current $i_p$ and the measured current $i_m$;

(vi)—repeating steps (ii) to (v) for at least n−1 further sets of video data signals;

(vii)—calculating an X value for each transistor using the calculated g values;

(viii)—replacing the stored X values with the calculated X values; and (ix)—correcting subsequent video data signals in accordance with the stored X values.

2. A method according to claim 1, wherein the method further comprises the steps of:

(x)—storing the g values in a column vector G having a length n; and, (xi)—performing an iterative Newton Linearisation process using vector G to obtain the X value for each transistor.

3. A method according to claim 2, wherein said Newton Linearisation process includes the steps of:

(xii)—differentiating vector G to obtain an n x n matrix G';

(xiii)—solving the equation:

$$G'(X).\delta X=-G(X)$$

for δX;

(xiv)—calculating an updated value for X for each transistor according to δX;

(xv)—calculating updated $g_i$ values using the updated X value; and, (xvi)—repeating steps (xii) to (xv) until the g values are within a predetermined range around zero.

4. A method according to claim 1, wherein said sets of video data signals have predetermined values $V_d$ to enable successful calculation of said X values in step (vii).

5. A method according to claim 1, wherein steps (ii) to (vii) are repeated periodically.

6. A method according to claim 1 carried out in response to switching on of said display device.

7. A method according to claim 1, wherein said electrical characteristic parameter X is a threshold voltage $v_t$ of the transistor.

8. A method according claim 7, wherein said model is based upon the relationship given by the equation:

$$i_{LED}=K(v_d-v_t)^2$$

in which $i_{LED}$ is the current controlled by one drive transistor and K is a constant.

9. Apparatus for correcting video data signals for addressing an active matrix display device, the device comprising a power line (10) arranged to supply current to n electroluminescent display elements (11), the current supplied to each element being controllable by a respective drive transistor (20), each drive transistor being addressable by video data signals each having a value $v_d$ and having an electrical characteristic parameter X, the apparatus comprising means (30) for storing the X value for each drive transistor;

means for applying a model to determine an expected current through the power line using the stored X values and video data signal values $v_d$, said video data signals corresponding to an image to be displayed;

means (32) for measuring a current through the power line;

means for applying an algorithm to said expected current and said measured current for a plurality of sets of video data signals to determine X values for each drive transistor;

correction circuitry for modifying received video data signals in accordance with the stored X values.

10. An active matrix display device comprising a plurality of power lines (10), each arranged to supply current to a respective plurality of electroluminescent display elements (11), the current supplied to each element being controllable by a respective drive transistor (20), each drive transistor being addressable by respective video data signals, said video data signals corresponding to an image to be displayed, wherein the display device further comprises apparatus according to claim 9 for correcting video data signals supplied to said transistors associated with each power line.

11. An integrated circuit chip (25) comprising an apparatus for correcting video data signals for addressing an active matrix display device, the device comprising a power line (10) arranged to supply current to n electroluminescent display elements (11), the current supplied to each element being controllable by a respective drive transistor (20), each drive transistor being addressable by video data signals each having a value $v_d$ and having an electrical characteristic parameter X, the apparatus comprising means (30) for storing the X value for each drive transistor;

means for applying a model to determine an expected current through the power line using the stored X values and video data signal values $v_d$, said video data signals corresponding to an image to be displayed;

means (32) for measuring a current through the power line;

means for applying an algorithm to said expected current and said measured current for a plurality of sets of video data signals to determine X values for each drive transistor;

correction circuitry for modifying received video data signals in accordance with the stored X values.

* * * * *